US011031232B1

(12) United States Patent
Stewart et al.

(10) Patent No.: US 11,031,232 B1
(45) Date of Patent: Jun. 8, 2021

(54) INJECTION OF IONS INTO AN ION STORAGE DEVICE

(71) Applicant: Thermo Fisher Scientific (Bremen) GmbH, Bremen (DE)

(72) Inventors: Hamish Stewart, Bremen (DE); Alexander A. Makarov, Bremen (DE); Christian Albrecht Hock, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 16/924,286

(22) Filed: Jul. 9, 2020

(30) Foreign Application Priority Data

May 10, 2019 (GB) ..... 1906589

(51) Int. Cl.
*H01J 49/42* (2006.01)
*H01J 49/00* (2006.01)

(52) U.S. Cl.
CPC ..... *H01J 49/423* (2013.01); *H01J 49/005* (2013.01); *H01J 49/426* (2013.01); *H01J 49/4225* (2013.01); *H01J 49/4295* (2013.01)

(58) Field of Classification Search
CPC .... H01J 49/005; H01J 49/4225; H01J 49/423; H01J 49/426; H01J 49/4925
See application file for complete search history.

(56) References Cited

U.S. PATENT DOCUMENTS 4,963,736 A 10/1990 Douglas et al.
5,179,278 A 1/1993 Douglas
(Continued)

FOREIGN PATENT DOCUMENTS

EP 3462476 A1 * 4/2019 ..... H01J 49/067
GB 2389705 B 2/2004
(Continued)

OTHER PUBLICATIONS

Combined Search and Examination Report dated Dec. 2, 2019, for GB Patent Application No. 1906589.5.
(Continued)

*Primary Examiner* — David E Smith

(57) ABSTRACT

A method of injecting ions into an ion storage device, comprising: providing an RF trapping field in the ion storage device that defines a trapping volume in the ion storage device by applying one or more RF voltages to one or more trapping electrodes; providing a gas in the trapping volume; injecting ions into the trapping volume through an aperture in an end electrode located at a first end of the ion storage device, the end electrode having a DC voltage applied thereto; reflecting the injected ions at a second end of the ion storage device, opposite to the first end, thereby returning the ions to the first end; and ramping the DC voltage applied to the end electrode during the period between injecting the ions through the aperture and the return of the ions to the first end, such that by the time the ions return to the first end for a first time a potential barrier is established by the ramped DC voltage that prevents returning ions from striking the end electrode. Also an apparatus for injecting ions into an ion storage device, which comprises a controller for ramping a first DC voltage applied to an end electrode of the device having an entrance aperture during a period between injection of ions through the entrance aperture and a return of the injected ions to the aperture so as to establish a potential barrier that prevents returning ions from striking the end electrode.

34 Claims, 5 Drawing Sheets

(56) References Cited

U.S. PATENT DOCUMENTS

| | | | | |
|---|---|---|---|---|
| 5,206,506 | A | 4/1993 | Kirchner | |
| 5,399,857 | A | 3/1995 | Doroshenko et al. | |
| 5,729,014 | A | 3/1998 | Mordehai et al. | |
| 5,811,800 | A | 9/1998 | Franzen et al. | |
| 5,818,055 | A | 10/1998 | Franzen | |
| 6,483,109 | B1 | 11/2002 | Reinhold et al. | |
| 6,627,883 | B2 | 9/2003 | Wang et al. | |
| 6,762,406 | B2 | 7/2004 | Cooks et al. | |
| 7,145,133 | B2 * | 12/2006 | Thomson | H01J 49/0081 250/281 |
| 7,189,965 | B2 | 3/2007 | Franzen | |
| 7,718,959 | B2 | 5/2010 | Franzen et al. | |
| 8,198,582 | B2 | 6/2012 | Raptakis et al. | |
| 9,190,255 | B2 * | 11/2015 | Raptakis | H01J 49/40 |
| 2003/0141447 | A1 * | 7/2003 | Verentchikov | H01J 49/065 250/287 |

FOREIGN PATENT DOCUMENTS

| | | | |
|---|---|---|---|
| WO | WO-9939370 | A1 | 8/1999 |
| WO | WO-2011148312 | A2 | 12/2011 |

OTHER PUBLICATIONS

Tolmachev A.V, et al., "A collisional focusing ion guide for coupling an atmospheric pressure ion source to a mass spectrometer", Nuclear Instruments and Methods in Physics Research Section B, vol. 124, 1997, pp. 112-119.

* cited by examiner

INJECTION OF IONS INTO AN ION STORAGE DEVICE

PRIORITY

This application claims priority to UK Patent Application 1906589.5, filed on May 10, 2019, and titled "Improved Injection of IONS into an ION Storage Device," by Stewart et al., which is hereby incorporated herein by reference in its entirety.

FIELD OF INVENTION

The invention relates to a method of injecting ions into an ion storage device and an apparatus for injecting ions into an ion storage device. Such methods and apparatus are useful in the field of mass spectrometry.

BACKGROUND TO THE INVENTION

In mass spectrometry, it is well known to use three-dimensional and two-dimensional (linear or toroidal) RF ion traps that utilise a combination of potential and pseudopotential wells in order to confine ions within the trap. One of the major applications of ion traps is as ion storage devices in the intermediate storage of ions prior to mass analysis. Where the stored ions are extracted to a mass analyser, the ion trap is often termed an extraction trap. In applications in which ions are only stored in the ion trap, i.e. not mass filtered, the trap is usually operated in "RF only mode", i.e. with no DC difference between the two RF voltages applied to the trap. Under these conditions the mass to charge ratio range of trapping is maximized but, in practice, the ratio of highest to lowest mass to charge ratio that can be trapped remains limited to about 15-20.

During the process of injecting ions into the ion trap, the ions typically are directed to enter the trap through the entrance aperture of the trap along the trap axis, following which the ions lose energy in low-energy collisions with a bath gas contained in the trap until they equilibrate with the gas, thus reducing their kinetic energy from several electronvolts down to thermal energies of the order of kT (where k is Boltzmann constant and T is the temperature of bath gas). When confining ions in an ion trap, Coulombic repulsion, or space charge, between the trapped ions opposes the confining forces of the applied potential and pseudopotential wells. As the number of trapped ions increases, the potential resulting from the space charge increases. This space charge potential opposes the confining potential of the trap. As the space charge potential approaches that of the potential well depth, the spatial distribution of the ions in the ion trap expands rapidly. Large spatial distributions of ions are undesirable, as this may negatively affect the transmission and/or resolution of the mass analyser into which the ions are extracted from the ion trap.

Numerous ion injection schemes into ion traps are known, including for injection into traps of the Paul type (U.S. Pat. Nos. 5,179,278; 5,399,857; 5,729,014; 5,818,055; WO9939370), or linear trap type (U.S. Pat. No. 6,627,883; WO2011148312, GB2389705), or comprising multiple cells (U.S. Pat. Nos. 5,206,506; 6,483,109; 6,762,406; 7,189,965; 7,145,133; 7,718,959). Further injection schemes for ion storage traps are disclosed in U.S. Pat. No. 5,811,800, GB2389705, U.S. Pat. Nos. 8,198,582 and 9,190,255.

As known in the art, the distance over which ions lose energy in the ion trap through collisions, or "braking length", is much longer for higher m/z ions than for lower m/z ions due to the higher ratio of their initial momentum (m*v where v is initial speed) to their cross-section (roughly proportional to $m^{2/3}$). Thus, in order to become trapped, heavy ions must travel much longer distances in the trap than light ions (see A. V. Tolmachev et al. NIM Phys Res. B 124 (1997) 112-119). As the pseudo-potential well depth is inversely proportional to m/z of ions, heavy ions are also less focused by RF fields than light ions and therefore could experience higher losses in the trap as they come back to the entrance aperture with smaller loss of energy. Over time, these losses result in build-up of thick layers of sample material from the deposited ions, which can start to charge up and disrupt ion transport through the aperture. The resulting loss of performance means that thorough cleaning of affected apertures is required, which involves tedious disassembly of sensitive trap optics.

Against this background the present invention has been made.

SUMMARY OF THE INVENTION

According to an aspect of the invention there is provided a method of injecting ions into an ion storage device according to claim 1.

A method of injecting ions into an ion storage device according to the invention comprises: providing an RF trapping field in the ion storage device that defines a trapping volume in the ion storage device; providing a gas in the trapping volume; injecting ions into the trapping volume through an aperture in an end electrode located at a first end of the ion storage device, the end electrode having a DC voltage applied thereto and the ions having a range of mass-to-charge ratios (m/z) wherein the range has a maximum mass-to-charge ratio, $m/z_{MAX}$; reflecting the injected ions at a second end of the ion storage device, opposite to the first end, thereby returning the ions to the first end; and ramping the DC voltage applied to the end electrode during at least a period from injecting the ions through the aperture to the return of the ions to the first end, such that by the time the ions return to the first end a potential barrier is provided by the DC voltage that prevents the returning ions from striking the end electrode. After injecting ions into the ion storage device the ions are preferably stored in the ion trapping volume of the device, typically by cooling the ions in the ion storage device by collisions with the gas. Thereafter, the ions may be mass analysed, for example by transferring the ions from the ion storage device into a mass analyser for mass analysis of the ions.

A method of mass spectrometry is also provided, comprising injecting ions into an ion storage device in accordance with the invention, storing the ions in the ion storage device, transferring the ions from the ion storage device into a mass analyser and mass analysing the ions, for example to produce a mass spectrum. The method typically comprises generating ions in an ion source. The generated ions, or product ions produced from the generated ions, such as fragment ions, are then injected into the ion storage device.

An apparatus is provided for carrying out the method as herein described.

According to a further aspect of the invention there is provided an apparatus for injecting ions into an ion storage device, in particular according to claim 20.

According to a still further aspect of the invention there is provided a mass spectrometer. The mass spectrometer can comprise an ion source for generating ions, an apparatus according to the invention for injecting ions into an ion storage device and a mass analyser for receiving ions from the ion storage device.

The invention results in a reduced rate of contamination of apertures of ion storage devices, such as ion traps, by appropriate timing of a DC voltage ramp on one or more electrodes of the device, preferably coinciding with a pulsed transfer of ions into the device, i.e. applying a dynamic DC voltage to the entrance aperture. The contamination of apertures during ion injection into the ion storage device is avoided by creating a potential barrier between the ions and the aperture during the time of return of the ions to the aperture following the initial injection through the aperture.

Various preferred details are now described.

In some preferred embodiments, establishing the potential barrier comprises starting ramping the DC voltage applied to the end electrode no later than when the first ions are injected through the aperture. In some preferred embodiments, establishing the potential barrier comprises ramping the DC voltage applied to the end electrode applied to the end electrode during substantially the whole period between injecting the ions through the aperture and the return of the ions to the first end. In some preferred embodiments, the ions have a range of mass-to-charge ratios (m/z) and the range has a maximum mass-to-charge ratio, $m/z_{MAX}$, wherein injecting ions into the trapping volume comprises subjecting the ions to an acceleration voltage, V, and wherein ions of mass-to-charge ratio $m/z_{MAX}$ return to the first end after a time $t(m/z_{MAX})$ from injection through the aperture and a rate of ramping the DC voltage applied to the end electrode is given by $(X*V+kT)/t(m/z_{MAX})$, where X is a factor from 0.01 to 1, k is the Boltzmann constant and T is the temperature of the gas. In some preferred embodiments, X is a factor (i) from 0.01 to 0.1, or (ii) 0.01 to 0.2.

An advantage of using a relatively slow DC voltage ramp on the end electrode is that contamination of the entry aperture electrode by returning ions can be reduced whilst ions can be admitted to the ion trap over a considerable period of time, for example, one or more milliseconds (ms), which improves the trapping of a wider mass range, and allows ions to travel some distance to the aperture if the ion cloud is large or the gas pressure is relatively high. As discussed in more detail below, a relatively long travel distance also improves ion transmission through the aperture. In the prior art, EP 3462476 A1 and US 2003/141447 A1, a voltage barrier on an end electrode is switched on rapidly, i.e. not ramped, at a point in time after a desired number of ions have entered an ion trap, the timing of the barrier being limited to when the first (i.e. lowest m/z) ions reflect back to the entry aperture, which in practice can often be before some (i.e. highest m/z) species of ions have even entered the trap. For the stated ion injection times in US 2003/141447 A1 of 10-100 microseconds (p), the voltage barrier must be lowered and raised in a much shorter time than this <10 microseconds (μs). If the timing before rapidly raising the voltage barrier is delayed to allow higher mass ions to enter, then lower m/z ions will have already returned to the entry aperture and been deposited there. In contrast, a slow ramping of DC voltage barrier (as opposed to the rapid switch of the prior art) as utilised in the present invention prevents lower m/z ions that are reflected back to the entry aperture first from being deposited (as they have lost the most energy and require a smaller barrier to stop them) whilst at the same time still allowing ions that have not yet lost energy to enter during the voltage ramp. By the time the higher energy, higher m/z ions return to the entry aperture the voltage barrier is high enough to prevent such ions from depositing.

In some preferred embodiments, the method comprises cooling the ions in the trapping volume by collisions with the gas until the ions are thermalised with the gas.

In some preferred embodiments, the ion storage device is elongated along a direction of elongation, the trapping volume has a length L in the direction of elongation and the gas has a pressure P in the trapping volume, such that P*L is between 0.01 and 1 mbar*mm, and wherein the ions are injected into the trapping volume in the direction of elongation. In some preferred embodiments, the one or more trapping electrodes of the ion storage device are elongated along the direction of elongation of the ion storage device.

Some preferred embodiments comprise injecting ions into the trapping volume comprises injecting the ions as a pulse of duration not greater than 5 milliseconds, such as a pulse of duration 0.1 to 3 milliseconds.

Some preferred embodiments comprise injecting the ions comprises injecting the ions from an ion injection device. In some preferred embodiments, injecting the ions comprises injecting the ions from an ion injection device that is an RF ion injection device. Injecting ions preferably can comprises injecting the ions from a gas-filled ion injection device. In some preferred embodiments, a pressure $P_2$ in the gas-filled ion injection device is greater than a pressure P in the trapping volume of the ion storage device. In some preferred embodiments, prior to injecting the ions into the trapping volume of the ion storage device, the ions are trapped in the ion injection device. In some preferred embodiments, the ion injection device comprises an arrangement of trapping electrodes having RF voltages applied to them, the arrangement of trapping electrodes having an inscribed radius R, and, prior to injecting the ions into the trapping volume of the ion storage device, the ions are trapped in the ion injection device at a distance of at least 2*R from the aperture in the end electrode of the ion storage device. In some preferred embodiments, prior to injecting the ions into the trapping volume of the ion storage device, the ions are trapped in the ion injection device at a distance of 2*R to 3*R from the aperture in the end electrode of the ion storage device. In some preferred embodiments, prior to injecting the ions into the trapping volume of the ion storage device, the ions are trapped in the ion injection device by setting trapping voltages on the end electrode of the ion storage device and/or on the trapping electrodes of the ion injection device so as to provide a DC offset potential between the end electrode of the ion storage device and the trapping electrodes of the ion injection device, and the ions are injected through the aperture in the end electrode by changing one or more of the trapping voltages to release the trapped ions from the ion injection device, wherein the time taken to change the trapping voltages is less than the time taken for released ions of a lowest mass-to-charge ratio to reach the aperture, and wherein the ramping of the DC voltage applied to the end electrode starts no later than the time when the first ions reach the aperture in the end electrode. Some preferred embodiments comprise passing ions through the ion storage device to the ion injection device before injecting the ions from the ion injection device into the ion storage device.

In some preferred embodiments, the ions injected into the ion storage device comprise fragment ions and the method further comprises fragmenting ions in the ion injection device to produce the fragment ions before injecting the fragment ions from the ion injection device into the ion storage device.

The invention also provides a method of mass spectrometry, comprising injecting ions into an ion storage device in accordance with the methods of the invention described herein, storing the ions in the ion storage device, transferring the ions from the ion storage device into a mass analyser and mass analysing the ions.

An apparatus for injecting ions into an ion storage device according to an aspect of the invention comprises:

- an ion storage device having one or more trapping electrodes for providing an RF trapping field when one or more RF voltages are applied thereto, the RF trapping field defining a trapping volume in the ion storage device;
- a gas inlet for providing a gas in the trapping volume;
- a first end electrode located at a first end of the ion storage device and having an aperture therein, the end electrode being configured to have a first DC voltage applied thereto; and
- a second end electrode located at a second end of the ion storage device, opposite to the first end, and configured to have a second DC voltage applied thereto for reflecting ions back to the first end; and
- a controller for ramping the first DC voltage during a period between an injection of ions through the aperture and a first return of the injected ions to the first end after reflection by the second DC voltage so as to establish a potential barrier that prevents returning ions from striking the first end electrode.

In some preferred embodiments, the controller is configured to ramp the first DC voltage at a rate given by $(X*V+kT)/t(m/z_{MAX})$, where X is a factor from 0.01 to 1, V is an acceleration voltage to which the injected ions are subjected, k is the Boltzmann constant, T is the temperature of a gas present in the trapping volume and $t(m/z_{MAX})$ is a time for ions of a maximum mass-to-charge ratio, $m/z_{MAX}$, to return to the first end of the ion storage device after injection through the aperture. In some preferred embodiments, the ion storage device is elongated along a direction of elongation and is configured to receive ions through the aperture along the direction of elongation, wherein the trapping volume has a length L in the direction of elongation, and wherein the ion storage device is configured to be filled with a gas at a pressure P in use, such that P*L is between 0.01 and 1 mbar*mm.

In some preferred embodiments, the one or more trapping electrodes of the ion storage device are elongated along the direction of elongation of the ion storage device.

Some preferred embodiments comprise an ion injection device for injecting the ions into the ion storage device through the aperture.

In some preferred embodiments, the ion injection device is configured to inject the ions into the ion storage device through the aperture as a pulse of duration not greater than 5 milliseconds. In some preferred embodiments, the ion injection device is an RF ion injection device. In some preferred embodiments, the ion injection device is a gas-filled ion injection device. In some preferred embodiments, the ion injection device is configured to be filled with a gas in use at a pressure $P_2$, wherein $P_2$ is greater than a pressure P of a gas in the trapping volume of the ion storage device. In some preferred embodiments, the ion injection device is configured to trap ions prior to injecting the ions into the trapping volume of the ion storage device. In some preferred embodiments, the ion injection device comprises an arrangement of trapping electrodes configured to have RF voltages applied to them, and the controller is configured to set trapping voltages on the first end electrode of the ion storage device and/or on the trapping electrodes of the ion injection device so as to provide a DC offset potential between the first end electrode of the ion storage device and the trapping electrodes of the ion injection device thereby to trap ions in the ion injection device for a trapping period. In some preferred embodiments, the arrangement of trapping electrodes of the ion injection device has an inscribed radius R, and the controller is configured to set the trapping voltages such that the ions are trapped in the ion injection device at a distance of at least 2*R from the aperture in the first end electrode of the ion storage device. In some preferred embodiments, the controller is configured to set the trapping voltages such that the ions are trapped in the ion injection device at a distance of 2*R to 3*R from the aperture in the first end electrode of the ion storage device.

In some preferred embodiments, the controller is configured to change one or more of the trapping voltages after the trapping period to release the trapped ions from the ion injection device, wherein the time taken to change the trapping voltages is less than the time taken for released ions of a lowest mass-to-charge ratio to reach the aperture in the first end electrode, and wherein the ramping of the DC voltage applied to the first end electrode starts no later than the time when the first ions reach the aperture in the first end electrode from the ion injection device.

In some preferred embodiments, the ion injection device is configured to be operable as a fragmentation cell.

In some preferred embodiments, the second end electrode has an aperture therein through which ions can pass into and/or out of the ion storage device.

The invention further provides a mass spectrometer, comprising: an ion source for generating ions, an apparatus according to the invention as described herein and a mass analyser for receiving ions from the ion storage device.

Further details of the invention are now described.

The ions may be generated in an ion source from a sample, wherein the ions have an initial range of mass-to-charge ratios.

The ions may be generated from a biological sample such as, for example, blood, tissue, plant extract, urine, serum, cell lysate and others. The ions may be generated from one or more samples containing one or more different molecules e.g. one or more molecules selected from one or more of: biopolymers, proteins, peptides, polypeptides, amino acids, carbohydrates, sugars, fatty acids, lipids, vitamins, hormones, polysaccharides, phosphorylated peptides, phosphorylated proteins, glycopeptides, glycoproteins, oligionucleotides, oligionucleosides, DNA, fragments of DNA, cDNA, fragments of cDNA, RNA, fragments of RNA, mRNA, fragments of mRNA, tRNA, fragments of tRNA, monoclonal antibodies, polyclonal antibodies, ribonucleases, enzymes, metabolites, and/or steroids. Thus, the ions may be ions of any of the aforementioned molecules.

The sample typically comprises a plurality of different molecules (i.e. different molecular species), which give rise to a plurality of different ions having a range of mass-to-charge ratios (m/z). The sample may comprise at least 2, 5, 10, 20, 50 different molecules, or may be a complex sample comprising at least 100, 500, 1000, or 5000 different molecules.

The ions can be generated from a sample by any of the following ion sources: electrospray ionisation (ESI), atmospheric pressure chemical ionisation (APCI), atmospheric pressure photoionisation (APPI), atmospheric pressure gas chromatography (APGC) with glow discharge, AP-MALDI, laser desorption (LD), inlet ionization, DESI, laser ablation electrospray ionisation (LAESI), inductively coupled plasma (ICP), laser ablation inductively coupled plasma (LA-ICP), etc. Furthermore, any of these ion sources can be interfaced to any of the following sample separations upstream of the ion source: liquid chromatography (LC), ion chromatography (IC), gas chromatography (GC), capillary zone electrophoresis (CZE), two dimensional GC (GC×GC), two dimensional LC (LC×LC), etc.

The ions injected into the ion storage device may be parent ions generated in an ion source or may be fragment ions produced by fragmentation of the parent ions, for example in a fragmentation device such as a collision cell. The fragmentation device may be located between the ion source and ion storage device. Alternatively, the fragmentation device may be located downstream of the ion storage device. In the downstream case, the parent ions may first pass through the ion storage device on their way to the fragmentation device, or the ions may be guided to bypass the ion storage device to reach the fragmentation device. The fragment ions are then returned in the upstream direction to be injected into the ion storage device.

The ion storage device is preferably an ion trap. The ion storage device preferably comprises one or more trapping electrodes, i.e. ion trapping electrodes, whereby the RF trapping field is generated by applying RF voltages to the RF trapping electrodes. Preferably a plurality of RF trapping electrodes are provided. The RF trapping electrodes are preferably elongated electrodes, such as rods. Preferably, the ion storage device is elongated (i.e. has its longest dimension) along a direction of elongation. In such embodiments, the elongated rods may be arranged to form a multipole, preferably a linear multipole, such as quadrupole, hexapole or octupole. The ion storage device is preferably an RF multipole device. The RF trapping electrodes may be provided as a series of ring electrodes or apertured plate electrodes spaced apart along the axis of the ion storage device. The ion storage device may thus be provided as a linear ion trap. The linear ion trap may have a straight axis or a curved axis (e.g. as present in a so-called curved linear ion trap or C-trap).

The aperture in the end electrode through which the ions are injected into the ion trapping volume may be termed herein the injection aperture. The end electrode through which the ions are injected into the ion trapping volume may be a first end electrode of the ion storage device. A second end electrode is preferably located at the second end of the ion storage device to which a DC voltage is applied in use to reflect ions when they reach the second end and return them towards the first end. The trapping volume can thus be defined between the first and second end electrodes. The DC voltage applied to the second end electrode to reflect the ions forms a potential barrier to prevent the ions from striking the second end electrode. In some embodiments, the second end electrode may be provided without an aperture for ion transmission. In some other embodiments, the second end electrode may be provided with an aperture through which the ions may pass when the DC voltage applied to the second end electrode is set to allow ions to pass through (i.e. not forming a potential barrier to the ions). In this way, stored ions can be ejected out of the ion storage device through the aperture in the second end electrode. In some embodiments, the ions can enter the ion storage device for a first time through the aperture in the second end electrode before exiting the ion storage device through the aperture in the first end electrode, following which the ions may be returned to the ion storage device through the first aperture in accordance with the invention.

Establishing the potential barrier preferably comprises ramping the DC voltage applied to the end electrode during the period between injecting the ions through the aperture and the return of the ions to the first end, such that by the time the ions return to the first end for a first time the potential barrier is provided by the DC voltage, such that returning ions are prevented from striking the end electrode. Preferably, ramping the DC voltage applied to the end electrode starts no later than when the first ions are injected, i.e. transit, through the aperture. Preferably, the ramping the DC voltage is performed while all ions transit through the aperture and typically continues for a period thereafter until the potential barrier is sufficiently established.

The ions typically have a range of mass-to-charge ratios (m/z), wherein the range has a maximum mass-to-charge ratio, $m/z_{MAX}$. The ions of mass-to-charge ratio, $m/z_{MAX}$ return to the first end of the ion storage device after a time $t(m/z_{MAX})$ from injection through the aperture. A rate of ramping the DC voltage applied to the end electrode is preferably given by $(X*V+kT)/t(m/z_{MAX})$, where X is a factor from 0.01 to 1, V is an acceleration voltage applied to the ions to inject them into the trapping volume, k is the Boltzmann constant and T is the temperature of the gas. In other words, the rate is preferably in the range from $(0.01*V+kT)/t(m/z_{MAX})$ to $(V+kT)/t(m/z_{MAX})$. Preferably, X is from 0.01 to 0.1. X can also be 0.01 to 0.2, or 0.01 to 0.3, or 0.01 to 0.4, or 0.01 to 0.5.

The injection of ions into the trapping volume preferably comprises injecting the ions as a pulse of duration not greater than 5 milliseconds (ms) or 3 ms and more preferably less than 3 ms, which can be less than 2 ms, or less than 1 ms. Typically, the ions are injected as a pulse of duration of at least 0.1 ms or at least 0.2 ms. For example, the ions can be injected as a pulse of duration 0.1 to 5 ms, or 0.2 to 5 ms, or 0.1 to 3 ms, or 0.2 to 3 ms. An injection pulse duration of 1 to 2 ms is typically suitable.

Preferably, the ion storage device is elongated (i.e. has its longest dimension) along a direction of elongation and the trapping volume has a length L in the direction of elongation and the gas has a pressure P in the trapping volume. Preferably, the pressure P is such that P*L is between 0.01 and 1 mbar*mm. In some embodiments, P*L is between 0.01 and 0.1 mbar*mm. The ions are generally injected into the ion storage device along the direction of elongation in such embodiments.

The method of injecting ions into an ion storage device preferably comprises storing the ions in the ion storage device after injection, generally after cooling the ions in the ion storage device, e.g. after thermalisation.

After cooling and/or storing the ions in the ion storage device, the ions may be mass analysed, for example by transferring the ions from the ion storage device into a mass analyser for mass analysis. In some embodiments, the ions can be ejected from the ion storage device along the longitudinal axis of the device, which can be the axis along which the ions are injected into the device (so-called axial ejection). In some embodiments, the ions can be ejected from the ion storage device along a radial axis of the device, which can be orthogonal to the axis along which the ions are injected into the device (so-called radial ejection).

The ions can be injected into the trapping volume as a pulse of duration longer than 100 microseconds but not greater than 5 milliseconds. The ions can be injected into the trapping volume of the ion storage device from an ion injection device, preferably a pulsed ion injection device. The ion injection device is preferably an RF ion injection device, i.e. employing an RF trapping field to confine the ions therein. In some embodiments, the ion injection device can be a gas-filled ion injection device. The ion injection device can be a collision cell, which can be operated to either fragment or not fragment the ions. The collision cell may be a higher energy collision dissociation (HCD) cell. A pressure $P_2$ in the gas-filled ion injection device is preferably greater than a pressure P in the trapping volume of the ion storage device. The ion injection device can comprise an arrangement of trapping electrodes (preferably elongated electrodes, such as rods for example) having RF voltages applied to them, for example an arrangement of trapping electrodes forming a multipole device, such as a quadruple. The arrangement of trapping electrodes may have an inscribed radius R, and, prior to injecting the ions into the trapping volume of the ion storage device (preferably immediately prior to injecting the ions), the ions are trapped in the ion injection device at a distance of at least 2*R from the aperture in the end electrode of the ion storage device (preferably at a distance from 2*R to 3*R from the aperture). The ions can be trapped in the ion injection device by setting DC voltages appropriately on the end electrode of the ion storage device and/or on the trapping electrodes of the ion injection device (such that there is a DC offset potential between the end electrode of the ion storage device and the trapping electrodes of the ion injection device). The ions can be injected through the aperture in the end electrode of the ion storage device by changing the DC trapping voltage of the ion injection device or the DC voltage of the end electrode of the ion storage device (in some embodiments, this can comprise changing both the DC trapping voltage of the ion injection device and the DC voltage of the end electrode) to release the trapped ions from the ion injection device, wherein the time taken to change the trapping voltages is preferably less than the time taken for released ions of a lowest mass-to-charge ratio to reach the aperture. In such embodiments, the ramping of the DC voltage applied to the end electrode preferably starts no later than the time when the first ions reach the aperture in the end electrode after the first reflection. The trapping voltages of the ion injection device are preferably changed to accelerating regime so as to subject the ions to an acceleration voltage V to inject the ions into the ion storage device.

The method preferably further comprises cooling the ions in the trapping volume by collisions with the gas until the ions are thermalised with the gas.

After storing the ions in the ion storage device, the ions may be mass analysed by ejecting the ions, directly or indirectly, to a mass analyser. The ions preferably enter the mass analyser as a pulse from the ion storage device. Mass analysing ions typically comprises detecting ions to produce mass spectral data. The ions may be mass analysed using a mass analyser, generally located downstream of the ion storage device. The mass analyser may comprise an ion detector. The mass analyser may be able to separate the ions based on their mass-to-charge ratio and may comprise one or more of the following types of mass analyser: an ion trap, e.g. RF ion trap, electrostatic ion trap, electrostatic orbital ion trap (such as an Orbitrap™ mass analyser), Fourier transform (FTMS) mass analyser, Fourier transform ion cyclotron resonance (FT-ICR) mass analyser, time of flight (TOF) mass analyser, e.g. linear TOF mass analyser, orthogonal acceleration TOF (OA-TOF) mass analyser, reflectron TOF, multi-reflection TOF (MR-TOF) mass analyser, quadrupole mass analyser, or magnetic sector mass analyser. Preferably, the mass analyser is capable of high resolution and/or accurate mass (HR-AM). For example, a mass analyser that is capable of resolving power >25,000 or >50,000 or >100,000 or >200,000 at mass 400 and/or mass accuracy <10 ppm, or <5 ppm, or <3 ppm, or <2 ppm. Such mass analysers can include one of: a time-of-flight mass analyser; an orbital trapping mass analyser; and a Fourier Transform Ion Cyclotron Resonance (FT-ICR) mass analyser. Preferably, the mass analyser is capable of measuring all of the stored ions in one acquisition or scan. Preferred mass spectrometers comprise an electrostatic ion trap, electrostatic orbital trap, or an FT-ICR, or a TOF such as a single-reflection or multi-reflection (MR)-TOF (preferably MR-TOF). Ion detectors for such mass analysers may be used to detect the ions separated by the mass analyser. Image current detectors, electron multipliers, microchannel plates, scintillators and/or photomultipliers may be used to detect ions. Preferably, the mass analysis provides a quantitative analysis of the ions.

The described RF and DC voltages may be supplied from respective one or more voltage sources. Generally, at least one RF voltage source and at least one DC voltage source may be provided. The voltages are generally controlled by a controller. The controller may comprise a computer, i.e. a processor and memory, and preferably associated electronics, for controlling the described RF and DC voltages applied to the electrodes. The controller for example controls the timing of applying the described voltages, their magnitude and/or frequency. For instance, the controller controls the ramping of the DC voltage applied to the end electrode having the injection aperture. The computer of the controller may be programmed with a program for causing the controller to operate the ion storage device and/or the mass spectrometer in accordance with the invention. The program may be provided on a computer readable medium.

The mass spectrometer may further comprise a data processing system for receiving data from the mass analyser representative of the quantity of mass analysed ions and processing the data to provide quantitative analysis of the ions. The processed data may comprise a mass spectrum of the ions. The controller may compromise the data processing device. The computer of the controller may compromise the data processing device. The data processing device may comprise a data storage unit or memory for storing data in data sets. The stored data may be unprocessed data from the mass analyser and/or processed data.

The controller and/or data processing device may comprise an instrument interface, which is adapted to send signals and commands to and receive signals from the mass spectrometer to operate the mass spectrometer. As mentioned, the data processing system is configured to receive data from the mass analyser, e.g. via the instrument interface.

Preferably, the controller and/or data processing device further comprises visualization means, in particular a display and/or a printer, and interaction means, in particular a keyboard and/or a mouse, so that a user can view and enter information. When the controller and/or data processing device comprises visualization means and interaction means, operation of the spectrometer is preferably controlled via a graphical user interface (GUI). The controller and/or data processing device can be realized on a computer, which may be in a distributed form with a number of processing devices interconnected by a wired and/or wireless network.

In general, features of the apparatus of the invention are applicable to the method and vice versa.

DETAILED DESCRIPTION

In order to enable a more detailed understanding of the invention, various embodiments will now be described with reference to the drawings. It should be understood that the scope of the invention is not limited to such embodiments, which are examples only.

Figure 1:
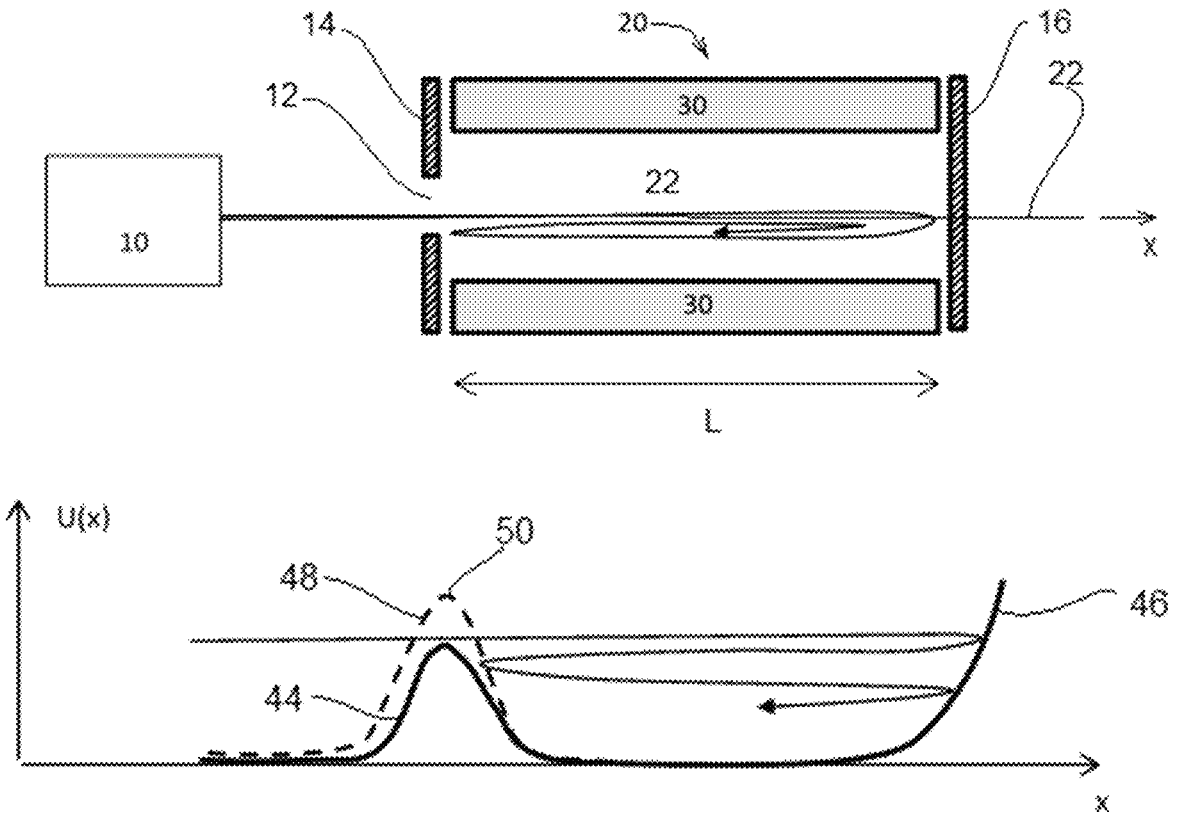
FIG. 1 shows schematically a first embodiment of the invention comprising an ion trap and voltage distributions U(x) along the longitudinal direction x of the ion trap.

FIG. 1 shows schematically a first embodiment of the invention. Ions are transferred to an ion storage device in the form of an ion trap 20 from an external injection ion trap 10. The storage ion trap 20 and injection ion trap 10 typically form part of a mass spectrometer that comprises other parts (not shown), such as an ion source located upstream of the external injection ion trap 10 for generating ions that are transferred to the ion trap 10 and a mass analyser downstream of the storage ion trap 20 to receive ions from the ion trap 20 and mass analyse them. To transfer the ions from the external injection ion trap 10 to the ion trap 20, they are accelerated by a voltage V, which can be achieved by providing a corresponding voltage offset between the receiving ion trap 20 and the injection ion trap 10 (e.g. by raising the potential of the external injection ion trap 10) but can be achieved by other means known in the art. The ions are delivered from the injection ion trap 10 as a short pulse, typically lasting less than 5 ms, such as 1-2 ms. The ions enter the receiving trap 20 along the longitudinal axis 22 of the trap 20 through an entrance aperture 12 in an end electrode 14. The end electrode 14 can take the form of a conductive (e.g. metal) plate having an aperture therein. Receiving ion trap 20 comprises a multipole having a plurality, e.g. 4, 6 etc., of elongated rod electrodes 30, elongated along the direction of elongation of the ion trap, to which are applied RF voltages that provide a trapping pseudopotential well to radially confine the ions. The receiving ion trap 20 is typically an RF-only ion trap, i.e. trapping a wide mass range of ions. In alternative embodiments, receiving ion trap 20 can comprise a series of apertured plates or rings or any other electrodes having RF voltages applied to them to radially confine the ions as known in the art. The ions are confined along the longitudinal axis 22 of the ion trap 20, which lies in direction x, by virtue of a DC potential gradient, which is provided by applying confining DC voltages to the entrance end electrode 14 and a second end electrode 16 located at the opposite end of the ion trap 20. The second end electrode 16 can take the form of a conductive (e.g. metal) plate. The ions are reflected by the potential gradient at the end-plate electrode 16 and return to the entrance end electrode 14. The ions are thereby confined in a trapping volume 22 inside the ion trap 20 defined by the potential and pseudopotential wells provided by end electrodes 14 and 16 and multipole rods 30. The trapping volume has a length L in the direction of elongation of the ion trap 20, which is generally the length of the rods 30.

The internal volume of the ion trap 20 is filled with a bath gas (e.g. nitrogen, argon, helium or a mixture of any two or more thereof) at a pressure P such that the product of pressure P by length L of the trap volume (i.e. P*L) is at least 0.01 mbar*mm. Under these conditions, low m/z ions lose energy relatively rapidly (typically many percent of their energy per reflection) and therefore cannot even approach the entrance aperture electrode 14 again but higher m/z ions may lose only a few percent of their energy per reflection and therefore could return to the entrance aperture electrode 14 with enough energy that they strike it as the RF field weakens near the aperture. Over time, dielectric films can build-up at the entrance aperture electrode that become increasingly charged and result in detuning of the aperture electrode and subsequent ion losses. The lower requirement on P*L is significantly lower than the approximately 0.1 mbar*mm following from U.S. Pat. No. 4,963,736 and the approach of the invention allows trapping of ions that are only partially cooled when they return to the entrance aperture. Moreover, it has been found that a curved linear ion trap (such as a C-trap) typically requires P*L that is about 2 times less than for a straight linear RF trap of the same length. At P*L above 1 mbar*mm, the energy loss of ions is typically so rapid that hardly any ions can reach the aperture on their return and therefore the invention is not generally needed.

In order to avoid the described loss of ions, in accordance with the invention the DC voltage $V_i$ applied to the end electrode 14 is ramped as the ions enter the trap 20 through the aperture 12 in the electrode and continues to ramp for a period following injection. Ions of charge state z and mass m return to the entrance end electrode 14 after a time, t(m/z), given by:

$$t\left(\frac{m}{z}\right) \approx \frac{2L}{\sqrt{\frac{2zeV}{m}}} \tag{1}$$

wherein $e=1.60210^{-19}$ Coulomb (i.e. the elementary charge), V is the acceleration voltage applied to the ions and L is the trap length. A change in the voltage $V_i$ on the entrance aperture of at least 1% of V during this time, i.e. during t(m/z), is typically sufficient to create a potential barrier between the returning ions and the entrance aperture (i.e. the end electrode 14) to prevent the ions from striking the end electrode. It should be noted that this voltage change should also include an additional margin reflecting the additional thermal energy spread kT of the ions, where k is Boltzmann constant ($1.38*10^{-23}$ J/K) and T is temperature of the bath gas, which reflects additional broadening of the ion velocity distribution upon collisions with the gas. Accordingly, the rate of voltage change in Volts/sec of the voltage $V_i$ preferably is given by:

$$\text{Rate}=(X*V+kT)/t(m/z_{MAX}) \tag{2}$$

wherein $t(m/z_{MAX})$ is the value of t(m/z) calculated for the maximum m/z of the ions of interest and X is a factor that determines the minimum safety margin. X is at least 0.01 and preferably between 0.01 and 1, for example, 0.01 or 0.02 or 0.05, or 0.1 or 0.2 etc. Preferred ranges of X are 0.01 to 0.1 and 0.01 to 0.2 but X may be from 0.01 up to 0.3 or 0.4 or 0.5 or 0.6 or 0.7 or 0.8 or 0.9. An increase of X above 1 is generally undesirable as it would restrict the duration of the incoming ion packet too much and decelerate collisional cooling within the trap. Values of X can be chosen by experimentation and/or using ion-optical modeling wherein X exhibits a dependence on aperture and trap dimensions, RF voltage, gas pressure, collisional cross-section of ion, etc. The voltages applied to the electrodes of the ion trap are supplied from one or more voltage sources forming part of a controller 50. The controller comprises a computer and associated electronics for controlling the described RF and DC voltages applied to the electrodes. The controller for example controls the timing of applying the described voltages, their magnitude and/or frequency.

The lower part of FIG. 1 shows the voltage distribution U(x) along the longitudinal direction x of the ion trap 20. The gradient is produced by the reflecting end potential 46 due to the DC voltage on the end electrode 16 together with the entrance aperture potential 44 due to the DC voltage on the entrance end electrode 14. The thick solid line indicates the initial potential distribution in the ion trap before the DC voltage ramp on the entrance end electrode starts (i.e. before injection), the dashed line 48 indicates the final potential distribution produced by ramping the entrance voltage as ions enter the trap. The thin solid line with arrow indicates the ion trajectory in both space and potential. It can be seen that ions are able to enter the ion trap through the entrance aperture with the initial potential distribution but by the time the ions are reflected and return to the entrance aperture the potential distribution there has changed due to the voltage ramp so that the final potential distribution 48 establishes a potential barrier 50 that prevents the returning ions from reaching the entrance end electrode 14 and being deposited there. The ions continue to be cooled in the trapping volume by collisions with the gas until the ions become thermalised with the gas and are stored in the ion trap ready for subsequent processing or mass analysis.

An example of a suitable ion trap that can be used in the invention, such as the embodiment of FIG. 1, can be provided by a quadrupole that has an inscribed radius $r_0$=3 mm, length L=30 mm, an applied RF voltage in the range of 500 to 3000 V peak-peak at 3 MHz and is filled with nitrogen gas at $1*10^{-3}$ mbar. The entrance aperture can be provided by an aperture of 2.5 mm internal diameter (ID) in an end electrode that is 0.5 to 1 mm thick. If ions are accelerated during their transfer from the injection trap 10 to the ion storage trap 20 by 5 Volts, the entrance aperture can tune at a voltage $V_i$=4.5 to 5.5 V. The opposite end electrode could be sustained at a voltage substantially higher than $V_i$, e.g. at 10-15 V. The full cycle of motion, i.e. forward motion, reflection and reverse motion, in the ion trap will take about 20 μs for ions of m/z=100 and 85 μs for ions of m/z=2000. If ions are ejected from the injection ion trap within 1 ms, $V_i$ could be ramped at 1 V/ms to ensure that even the heaviest ions do not return to deposit on the entrance aperture after the reflection.

Figure 2:
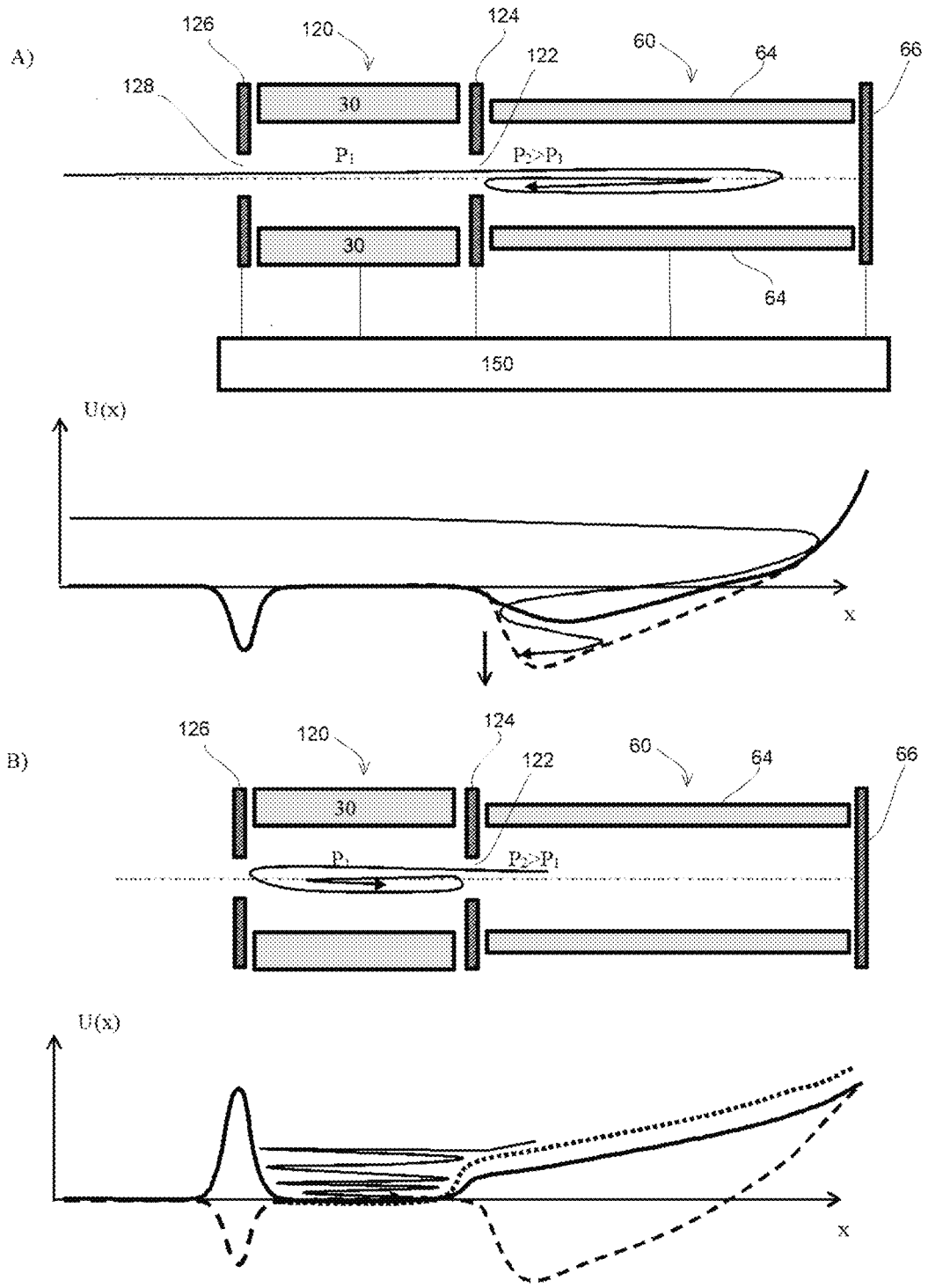
FIG. 2 shows schematically a further embodiment of the invention comprising a C-trap/HCD cell combination and voltage distributions U(x) along the longitudinal direction x C-trap/HCD cell.

A further embodiment is shown schematically in FIG. 2, which comprises a C-trap/HCD (collision cell) combination known in the art, for example in the Exactive™ series of Orbitrap™ based mass spectrometers from Thermo Fisher Scientific.

In FIG. 2 A) ions represented by the thin line with an arrow are shown arriving from an external ion source (not shown) located to the left, which could be an electrospray ion (ESI) source, MALDI source etc. The arriving ions first pass through the ion storage device 120, which in this embodiment is a curved linear ion trap (C-trap), and into the higher energy collision dissociation (HCD) cell 60. The HCD cell acts as an ion injection device to inject ions into the C-trap as described in detail hereafter.

The C-trap is shown for simplicity with a straight longitudinal axis but it will be understood that a C-Trap actually has a curved axis. The C-trap 120 comprises elongated RF electrodes 30. The ions initially enter the C-trap 120 from the ion source (not shown) through an aperture 128 in an end electrode 126 and then pass out of the C-trap at the other end through an aperture 122 in an end electrode 124 and into the HCD cell 60. The aperture 122 thus acts as an inter-trap aperture between the C-trap and the HCD cell. The HCD cell 60 comprises an arrangement of four elongate trapping electrodes or rods 64 configured as a quadrupole and which have RF voltages applied to them. The HCD cell further comprises an end electrode 66 which has a DC voltage applied to it to reflect the ions. A controller 150 is configured to set RF voltages on the C-trap, trapping voltages on the end electrodes 124, 126 of the C-trap ion storage device and voltages on the electrodes of the ion injection device. The controller is configured to initially provide a DC offset potential between the end electrode 124 of the C-trap and the trapping electrodes 64 of the HCD cell thereby to trap ions in the HCD cell for a trapping period.

The ions lose energy within the HCD cell 60 in collisions with a bath gas contained therein at a pressure $P_2$ typically higher than the pressure $P_1$ in the C-trap 120. As examples, $P_1$ can be $2\times10^{-3}$ to $3\times10^{-3}$ mbar but may range from $0.5\times10^{-3}$ to $1\times10^{-2}$ mbar. As examples, $P_2$ can be $1\times10^{-2}$ mbar but may range from $1\times10^{-3}$ to $3\times10^{-2}$ mbar. For MS-only mass analysis (i.e. so-called MS1), fragmentation is avoided in the HCD cell by arranging the depth of a potential well in the HCD cell to be sufficiently shallow, e.g. of only 1-2 V (so that there is a sufficiently small potential offset between the C-trap and HCD cell). The potential well depth in the HCD cell is subsequently increased to bring the ions away from the inter-trap aperture 122. For MS/MS (or MS2) analysis in which the ions are fragmented, the HCD quadrupole rods 64 are biased to a voltage (e.g. negative voltage for positive ions) in order to create a depth of a potential well in the HCD cell corresponding to a desired collision energy and the produced fragment ions are collected at the bottom of the potential well (FIG. 2A, and FIG. 2B, dashed line). Thus, MS or MS/MS analysis can be performed depending on the initial depth of the potential well in the HCD cell. In the voltage distribution shown in FIG. 2 A), the solid line indicates the initial voltage distribution for MS mode and the dashed line indicates the final voltage distribution for MS mode or the initial distribution for MS/MS mode. The arrow shows the direction of voltage ramp on the HCD electrodes in MS mode to bring the ions away from the inter-trap aperture 122.

After a period, typically 1-5 ms, the trapped ions are injected from the HCD 60 into the C-trap 120, as shown schematically in FIG. 2 B), by the controller 150 raising the potential offset of the HCD rods 64 to a level above the C-trap rod offset (as indicated by the solid line in the voltage distribution shown in FIG. 2 B)) such that ions move through inter-trap aperture 122 into the C-trap 120 within a period less than 1-2 ms. The voltage on the opposite end electrode 126 of the C-trap is also raised when the HCD rod offset is raised to reflect the ions entering the C-trap and confine them for storage. In order to prevent the ions reflected from end electrode 126 from returning to deposit on the inter-trap aperture electrode 124, the voltage $V_i$ on the inter-trap aperture electrode 124 is raised during and after injection of ions from the HCD cell. The voltage $V_i$ on the inter-trap aperture 122 initially optimizes at 2-4 V for a HCD rod offset of 5-6 V and ramp rate of 1 V/ms starts from the moment when the HCD rod offset is raised. In the voltage distribution shown in FIG. 2 B), the dashed line indicates the potential distribution at the end of the step of ion trapping in the HCD cell 60, the solid line indicates the rapid change of voltages in injection mode to enable ion transfer into the C-trap 120 and the dotted line shows the voltage ramp on the inter-trap aperture electrode 124 as well as HCD rod offset to enable lossless transfer of ions into the C-trap 120.

Figure 3:
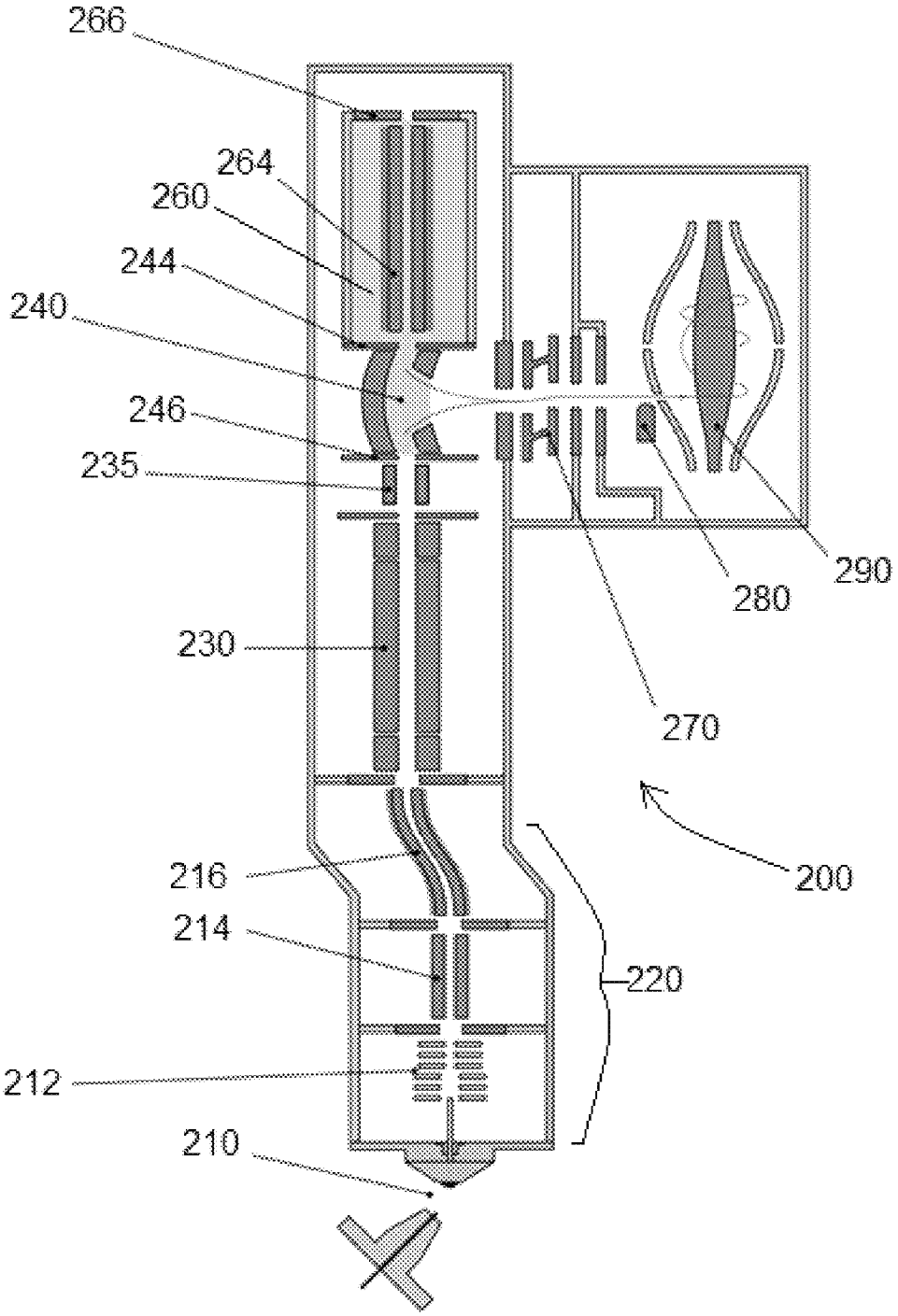
FIG. 3 shows another embodiment of the invention comprising a tandem mass spectrometer.

FIG. 3 shows schematically a tandem quadrupole-Orbitrap™ mass spectrometer 200 incorporating the invention and in particular a similar C-trap/HCD cell combination as shown in FIG. 2. Ions are passed from an electrospray ion source 210 (though other sources can be used) through a vacuum interface 220 incorporating a stacked ring lens (S-lens) 212 and a series of ions guides 214, 216, through a quadrupole mass filter 230 operated optionally in non-mass filtering or mass-filtering mode, through further ion guide 235, through an aperture in C-trap entrance electrode 246 into the C-trap 240, and through an aperture in C-trap exit electrode 244 into the gas-filled HCD cell 260, which comprises RF rods 264 and back end DC electrode 266. The ions optionally may be fragmented within the HCD cell 260 as described above with reference to FIG. 2. After a cooling and trapping period within the HCD cell 260, ions are returned to the C-trap 240 through the C-trap exit electrode 244 as described with reference to FIG. 2, and the voltage applied to this electrode is ramped over time in the manner described above to prevent contamination of the electrode. Ions are then further cooled and stored in the C-trap 240 before undergoing pulsed extraction from the C-trap, via injection ion optics 270 and ion deflector 280, to the Orbitrap mass analyser 290 for mass analysis.

Figure 4:
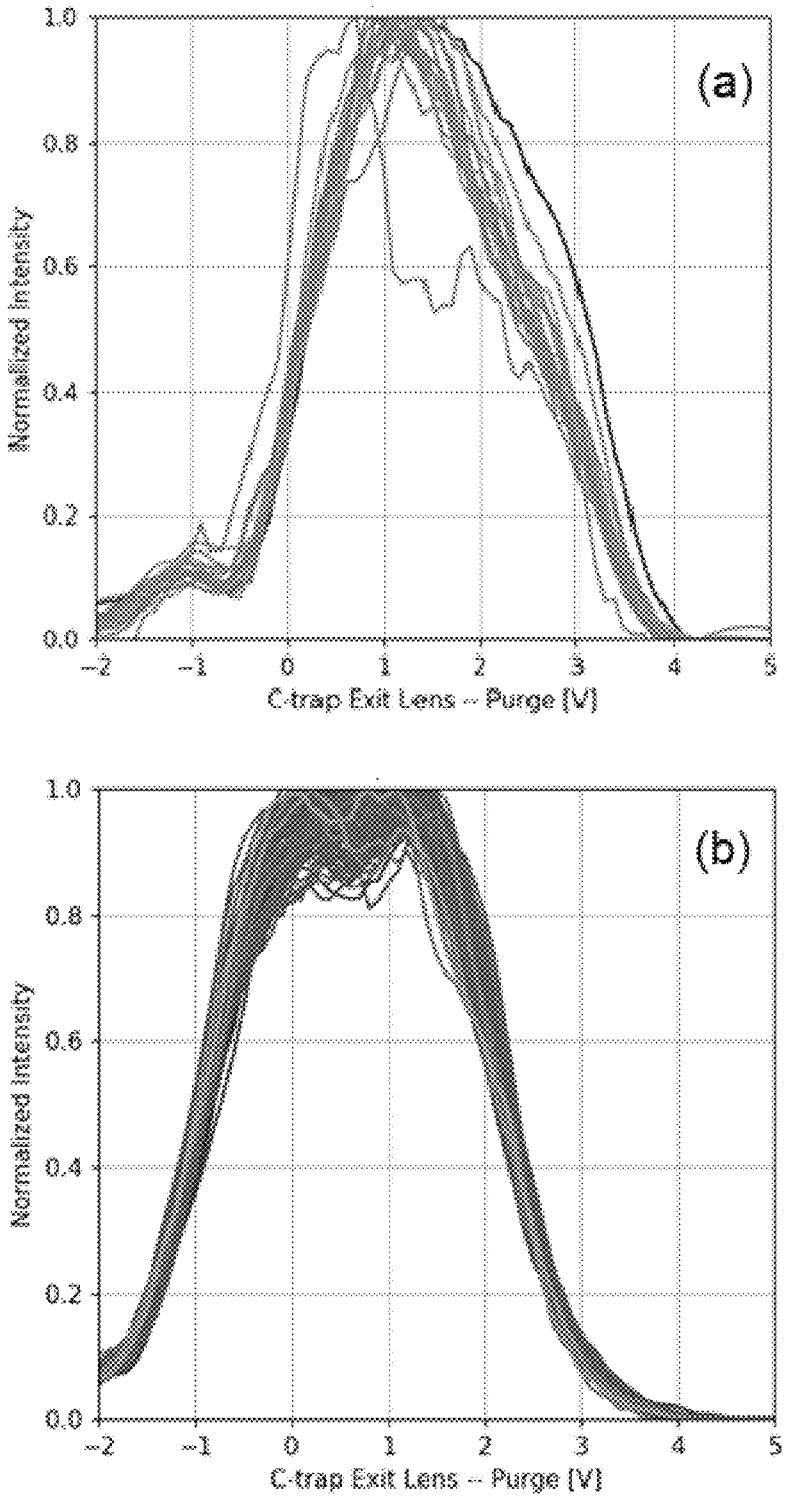
FIG. 4 shows experimental data indicating the evolution with time of the dependence of ion transmission on $V_i$(tuning curve) of the voltage $V_i$ on the inter-trap aperture electrode with increasing ion load for the $11^+$ ubiquitin ion. Lighter traces indicate later moments in time.

FIG. 4 shows experimental data indicating the evolution of the tuning curves of $V_i$ (voltage on the inter-trap aperture electrode 244) with increasing ion load. Each curve represents an increasing ion load. FIG. 4 *a*) shows the dependence of the ion transmission (normalized intensity) on $V_i$ (tuning curve) for +11 ions of ubiquitin protein with increasing ion load for a prior art method (i.e. no ramping of $V_i$ during transfer from HCD cell to C-trap; FIG. 4 *b*) shows the dependence of the ion transmission on $V_i$ (tuning curve) for +11 ions of ubiquitin protein with increasing ion load for a method according to the invention (i.e. employing a voltage ramp on the inter-trap aperture electrode 244).

To obtain the data, ubiquitin ions were injected at maximum current of 300-500 pA for a prolonged period simulating several months of typical operation through the C-trap 240 into the HCD cell 260 of a mass spectrometer similar to that shown in FIG. 3. Intermittently, $V_i$, the voltage applied to the C-trap exit lens 244 during the purging of the ions from the HCD cell to C-Trap, was scanned (in 0.1 or 0.2 V steps) and the ion intensity recorded to give the intensity profiles. In FIG. 4, the plots are shown for the unfragmented 11+ ubiquitin ion. As the RF in the C-Trap was set with a first mass-to-charge ratio target of 40 for fragment detection, the ubiquitin ion represents a severe case where the RF pseudopotential is relatively weak.

The effects of contamination by the ubiquitin over time were observed as a shift, or narrowing, over time of the intensity profile. FIG. 4 shows results of these experiments with (b) and without (a) the invention. It can be seen that without a dynamic voltage applied to the C-trap inter-trap lens according to the invention, the intensity profile shifts considerably over time as shown in FIG. 4 *a*). The application of the invention, however, both stabilises the decay on the right side of the curve and broadens the acceptance on the left side. It is most desirable for instrument performance that this curve does not shift significantly over time under increased ion load, and that the curve be as broad as possible to overlap optimum values of the voltage for different m/z ratios.

As $V_i$ in FIG. 4 *a*) was initially calibrated at 3V for calibration mixture, over the course of contamination by ubiquitin it shifted and distorted so much that transmission intensity for ubiquitin dropped by almost an order of magnitude at that voltage and thus transmission of this ion through the aperture was essentially stopped. The normalised intensities shown in FIG. 4 are normalised to the maximum of each separate curve and do not therefore show this substantial drop in intensity over time between scans. With the invention, a lower voltage of calibration (2V) became possible with 1 V/ms ramp and the tuning curve remained substantially unchanged over the course of the entire experiment for the same ubiquitin load. Typically, the HCD cell empties within 1-2 ms and therefore the ion energy in the C-trap does not reach values facilitating fragmentation, typically, an extra 1-2 V of entry energy is added.

Without being bound by any theory, the collapse of the right side of the tuning curve in FIG. 4 *a*) could be attributed to contamination of the end aperture on the HCD cell side, while collapse on the left side could be attributed to contamination of this aperture on the C-trap side. Modelling has shown that the former could be avoided by lowering $V_i$ and thus creating a stronger focusing electric field (and stabilising the right side of the curve as shown in FIG. 4 *b*). However, this results in faster ions entering the C-trap due to extra momentum being acquired by ions in a stronger electric field over the last few millimetres of the HCD cell. As such, these ions may return to the aperture at energies almost sufficient to return the ions into the HCD cell and find themselves very weakly focused inside the inter-trap aperture and so become lost there. This may accelerate contamination on the C-trap side of the aperture and therefore faster collapse on the left side of the tuning curve in FIG. 4 *a*). This is where the invention provides an advantage by allowing to establish a lower $V_i$ e.g. 2V instead of 3V. The otherwise unavoidable accelerated collapse of the tuning curve on the left side is avoided as ions are prevented from approaching the aperture from the C-trap side by the ramped voltage on the aperture and therefore the left side of the tuning curve also remains stable as shown in FIG. 4 *b*).

In order to take advantage of stronger ion focusing by a larger voltage along the HCD cell, it is preferred to store ions in the cell at a distance of at least $(2\text{-}3)*R_0$ away from the inter-trap aperture 244 where $R_0$ is the inscribed radius of the HCD cell. This could be achieved both in MS and MS/MS mode as illustrated in FIG. 2 by ensuring a sufficiently low HCD potential offset in both cases to trap the ions (for example, −10 V to −15 V relative to the aperture 244, or lower). This could be enabled by appropriately biasing the HCD rods 264 and/or raising the voltage on the aperture 244. As ions lose energy as they move down the HCD cell, the ion energy in equation (2) is usually above $V_i$ but lower than $V_i+E*\lambda$, where E is electric field near the aperture and $\lambda$ is mean braking length of the ion in gas. For simplicity, for extraction from gas-filled multipoles it is proposed to set $V \approx V_i$.

Figure 5:
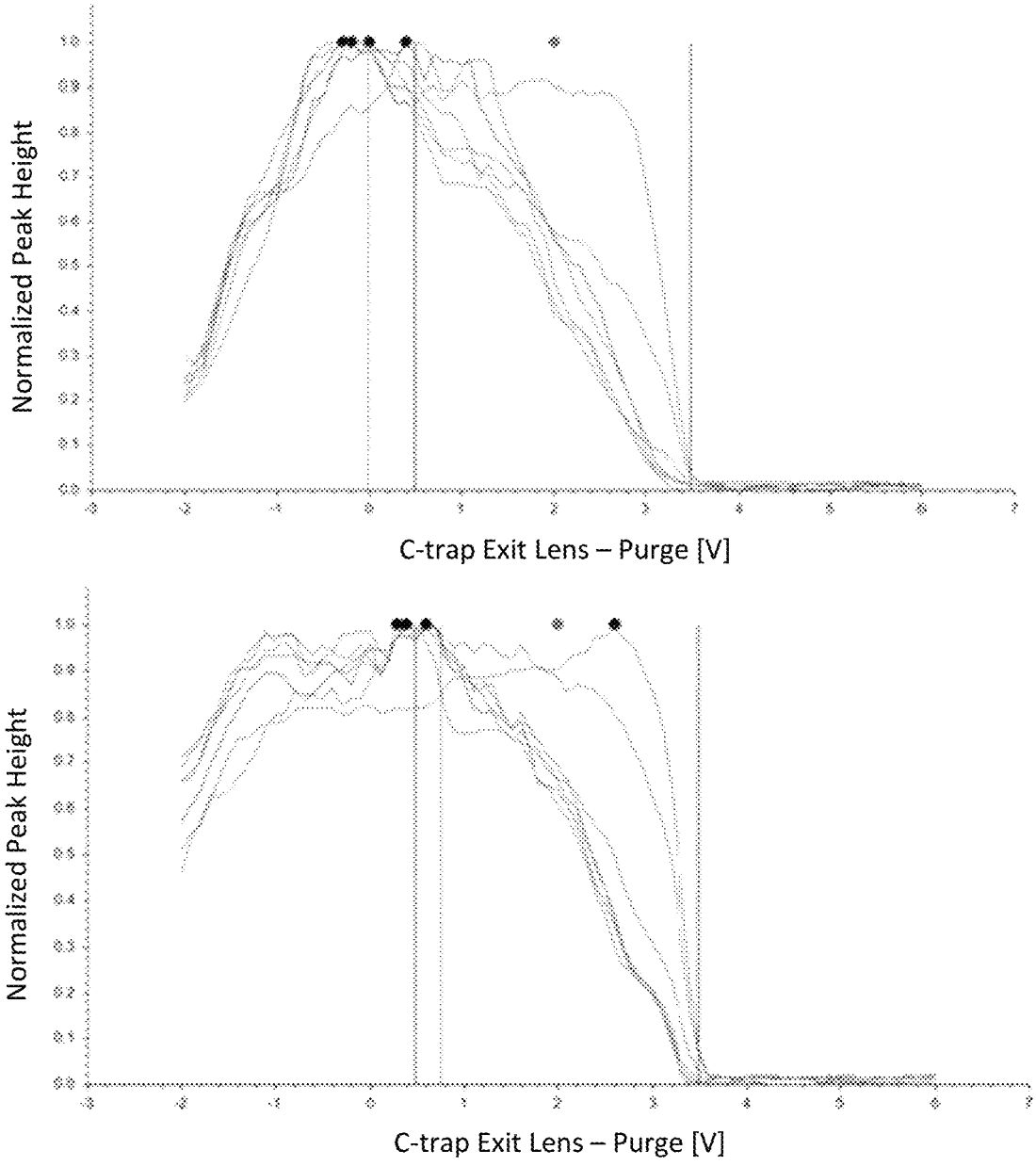
FIG. 5 shows the evolution with time of the dependence of ion transmission on $V_i$ (tuning curve) for ubiquitin ions of charge states $7\text{-}13^+$ where an intermediate trapping voltage on the HCD quadrupole was not applied (top plot) or was set to −20V (bottom plot).

FIG. 5 shows the dependence of ion transmission on $V_i$ (tuning curve) for ubiquitin ions of charge states 7-13$^+$ where intermediate (trapping) voltage on HCD quadrupole was disabled (top plot) or was set to −20V (bottom plot). In FIG. 5, multiply charged ubiquitin ions were injected into the HCD cell with 2 eV energy relative to the C-trap. At 3.5 ms before purge of the ions back to the C-trap, the HCD quadrupole rods were either maintained at an intermediate voltage −2V or biased to −20V to move the stored ions back from the aperture. The C-trap exit electrode voltage at the purge step was scanned and the detected ubiquitin ion intensities monitored. It can be seen that the tolerance to low exit lens voltages, the breadth of the $V_i$ tuning curve, increases markedly when the additional intermediate step of applying the −20V is used.

The ions stored in the C-trap can be injected subsequently into an Orbital trapping mass analyser as shown in FIG. 3, or in other embodiment into another type of mass analyser, such as a time-of-flight (ToF) analyser for example, or the ions may be further transferred downstream or upstream for additional processing as known in the art.

It will be appreciated that the polarities of the voltages described herein and with reference to the Figures are generally applicable to the storage of positive ions. For the storage of negative ions, opposite polarities to those described will be used.

It can be seen from the disclosure herein that the invention provides numerous advantages. Contamination of apertures during ion injection into an ion storage device such as an ion trap can be reduced or avoided by dynamically creating a potential barrier between the ions and an electrode at the aperture during the time of ion return to the electrode following the injection, with a preferred minimum voltage ramping rate. Contamination of the apertures can also be reduced by locating the ions in an ion injection device at an optimal distance from the aperture immediately prior to transfer of the ions into the ion storage device. The contamination of apertures on their outer side can be reduced by providing a sufficiently strong extraction field for injecting the ions.

Herein the term mass may be used to refer to mass-to-charge ratio (m/z), in Thomsons (Th). It will be understood that, although some embodiments may determine the mass or mass to charge ratio of ions, this is not essential to the successful operation of the invention. Many different physical parameters such as (but not limited to) time of flight, frequency, voltage, magnetic field deflection etc. may be measured (dependent for example on the chosen method of ion detection), each of which is related to or allows derivation of the ion mass or m/z, i.e. is representative of the mass or m/z. However it is not necessary that the mass or m/z itself is calculated in each case; it may be computationally more efficient not to convert measured parameters in a non-mass space into mass. The term mass spectrum herein thus means a spectrum in the m/z domain or spectrum in a domain directly related to or derivable from the m/z domain, such as the frequency domain for example. The term mass may also refer to m/z, or frequency or any other quantity directly related to m/z and vice versa (e.g. the term frequency refers also to mass etc.). The terms mass and m/z may thus be used herein interchangeably and accordingly a reference to one includes a reference to the other.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

The present invention also covers the exact terms, features, values and ranges etc. in case these terms, features, values and ranges etc. are used in conjunction with terms such as about, around, generally, substantially, essentially, at least etc. (e.g., "about 3" shall also cover exactly 3, or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The invention claimed is:

1. A method of injecting ions into an ion storage device, comprising:

providing an RF trapping field in the ion storage device that defines a trapping volume in the ion storage device by applying one or more RF voltages to one or more trapping electrodes;

providing a gas in the trapping volume;

injecting ions into the trapping volume through an aperture in an end electrode located at a first end of the ion storage device, the end electrode having a DC voltage applied thereto;

reflecting the injected ions at a second end of the ion storage device, opposite to the first end, thereby returning the ions to the first end; and ramping the DC voltage applied to the end electrode during substantially the whole period between injecting the ions through the aperture and the return of the ions to the first end, such that by the time the ions return to the first end for a first time a potential barrier is established by the ramped DC voltage that prevents returning ions from striking the end electrode.

2. A method according to claim 1, wherein establishing the potential barrier comprises starting ramping the DC voltage applied to the end electrode no later than when the first ions are injected through the aperture.

3. A method according to claim 1, wherein the ions have a range of mass-to-charge ratios (m/z) and the range has a maximum mass-to-charge ratio, $m/z_{MAX}$, wherein injecting ions into the trapping volume comprises subjecting the ions to an acceleration voltage, V, and wherein ions of mass-to-charge ratio $m/z_{MAX}$ return to the first end after a time $t(m/z_{MAX})$ from injection through the aperture and a rate of ramping the DC voltage applied to the end electrode is given by $(X*V+kT)/t(m/z_{MAX})$, where X is a factor from 0.01 to 1, k is the Boltzmann constant and T is the temperature of the gas.

4. A method according to claim 3, wherein X is a factor (i) from 0.01 to 0.1, or (ii) 0.01 to 0.2.

5. A method according to claim 1, further comprising cooling the ions in the trapping volume by collisions with the gas until the ions are thermalised with the gas.

6. A method according to claim 1, wherein the ion storage device is elongated along a direction of elongation, the trapping volume has a length L in the direction of elongation and the gas has a pressure P in the trapping volume, such that P*L is between 0.01 and 1 mbar*mm, and wherein the ions are injected into the trapping volume in the direction of elongation.

7. A method according to claim 6, wherein the one or more trapping electrodes of the ion storage device are elongated along the direction of elongation of the ion storage device.

8. A method according to claim 1, wherein injecting ions into the trapping volume comprises injecting the ions as a pulse of duration not greater than 5 milliseconds, such as a pulse of duration 0.1 to 3 milliseconds.

9. A method according to claim 1, wherein injecting the ions comprises injecting the ions from an ion injection device.

10. A method according to claim 9, wherein injecting the ions comprises injecting the ions from an ion injection device that is an RF ion injection device.

11. A method according to claim 9, wherein injecting ions comprises injecting the ions from a gas-filled ion injection device.

12. A method according to claim 11, wherein a pressure $P_2$ in the gas-filled ion injection device is greater than a pressure P in the trapping volume of the ion storage device.

13. A method according claim 9, wherein prior to injecting the ions into the trapping volume of the ion storage device, the ions are trapped in the ion injection device.

14. A method according to claim 13, wherein the ion injection device comprises an arrangement of trapping electrodes having RF voltages applied to them, the arrangement of trapping electrodes having an inscribed radius R, and, prior to injecting the ions into the trapping volume of the ion storage device, the ions are trapped in the ion injection device at a distance of at least 2*R from the aperture in the end electrode of the ion storage device.

15. A method according to claim 14, wherein prior to injecting the ions into the trapping volume of the ion storage device, the ions are trapped in the ion injection device at a distance of 2*R to 3*R from the aperture in the end electrode of the ion storage device.

16. A method according to claim 13, wherein, prior to injecting the ions into the trapping volume of the ion storage device, the ions are trapped in the ion injection device by setting trapping voltages on the end electrode of the ion storage device and/or on the trapping electrodes of the ion injection device so as to provide a DC offset potential between the end electrode of the ion storage device and the trapping electrodes of the ion injection device, and the ions are injected through the aperture in the end electrode by changing one or more of the trapping voltages to release the trapped ions from the ion injection device, wherein the time taken to change the trapping voltages is less than the time taken for released ions of a lowest mass-to-charge ratio to reach the aperture, and wherein the ramping of the DC voltage applied to the end electrode starts no later than the time when the first ions reach the aperture in the end electrode.

17. A method according to claim 9, further comprising passing ions through the ion storage device to the ion injection device before injecting the ions from the ion injection device into the ion storage device.

18. A method according to claim 9, wherein the ions injected into the ion storage device comprise fragment ions and the method further comprises fragmenting ions in the ion injection device to produce the fragment ions before injecting the fragment ions from the ion injection device into the ion storage device.

19. An apparatus for injecting ions into an ion storage device, comprising:

an ion storage device having one or more trapping electrodes for providing an RF trapping field when one or more RF voltages are applied thereto, the RF trapping field defining a trapping volume in the ion storage device;

a gas inlet for providing a gas in the trapping volume;

a first end electrode located at a first end of the ion storage device and having an aperture therein, the end electrode being configured to have a first DC voltage applied thereto; and a second end electrode located at a second end of the ion storage device, opposite to the first end, and configured to have a second DC voltage applied thereto for reflecting ions back to the first end; and a controller for ramping the first DC voltage during substantially the whole period between an injection of ions through the aperture and a first return of the injected ions to the first end after reflection by the second DC voltage so as to establish a potential barrier that prevents returning ions from striking the first end electrode.

20. An apparatus according to claim 19, wherein the controller is configured to ramp the first DC voltage at a rate given by $(X*V+kT)/t(m/z_{MAX})$, where X is a factor from 0.01 to 1, V is an acceleration voltage to which the injected ions are subjected, k is the Boltzmann constant, T is the temperature of a gas present in the trapping volume and $t(m/z_{MAX})$ is a time for ions of a maximum mass-to-charge ratio, $m/z_{MAX}$, to return to the first end of the ion storage device after injection through the aperture.

21. An apparatus according to claim 19, wherein the ion storage device is elongated along a direction of elongation and is configured to receive ions through the aperture along the direction of elongation, wherein the trapping volume has a length L in the direction of elongation, and wherein the ion storage device is configured to be filled with a gas at a pressure P in use, such that P*L is between 0.01 and 1 mbar*mm.

22. An apparatus according to claim 21, wherein the one or more trapping electrodes of the ion storage device are elongated along the direction of elongation of the ion storage device.

23. An apparatus according to claim 19, further comprising an ion injection device for injecting the ions into the ion storage device through the aperture.

24. An apparatus according to claim 23, wherein the ion injection device is configured to inject the ions into the ion storage device through the aperture as a pulse of duration not greater than 5 milliseconds.

25. An apparatus according to claim 23, wherein the ion injection device is an RF ion injection device.

26. An apparatus according to claim 23, wherein the ion injection device is a gas-filled ion injection device.

27. An apparatus according to claim 26, wherein the ion injection device is configured to be filled with a gas in use at a pressure $P_2$, wherein $P_2$ is greater than a pressure P of a gas in the trapping volume of the ion storage device.

28. An apparatus according to claim 23, wherein the ion injection device is configured to trap ions prior to injecting the ions into the trapping volume of the ion storage device.

29. An apparatus according to claim 28, wherein the ion injection device comprises an arrangement of trapping electrodes configured to have RF voltages applied to them, and the controller is configured to set trapping voltages on the first end electrode of the ion storage device and/or on the trapping electrodes of the ion injection device so as to provide a DC offset potential between the first end electrode of the ion storage device and the trapping electrodes of the ion injection device thereby to trap ions in the ion injection device for a trapping period.

30. An apparatus according to claim 29, wherein the arrangement of trapping electrodes of the ion injection device has an inscribed radius R, and the controller is configured to set the trapping voltages such that the ions are trapped in the ion injection device at a distance of at least 2*R from the aperture in the first end electrode of the ion storage device.

31. An apparatus according to claim 30, wherein the controller is configured to set the trapping voltages such that the ions are trapped in the ion injection device at a distance of 2*R to 3*R from the aperture in the first end electrode of the ion storage device.

32. An apparatus according to claim 29, wherein the controller is configured to change one or more of the trapping voltages after the trapping period to release the trapped ions from the ion injection device, wherein the time taken to change the trapping voltages is less than the time taken for released ions of a lowest mass-to-charge ratio to reach the aperture in the first end electrode, and wherein the ramping of the DC voltage applied to the first end electrode starts no later than the time when the first ions reach the aperture in the first end electrode from the ion injection device.

33. An apparatus according to claim 23, wherein the ion injection device is configured to be operable as a fragmentation cell.

34. An apparatus according to claim 23, wherein the second end electrode has an aperture therein through which ions can pass into and/or out of the ion storage device.

* * * * *